US010349189B2

(12) United States Patent
Kamkar-Parsi et al.

(10) Patent No.: US 10,349,189 B2
(45) Date of Patent: Jul. 9, 2019

(54) METHOD AND ACOUSTIC SYSTEM FOR DETERMINING A DIRECTION OF A USEFUL SIGNAL SOURCE

(71) Applicant: SIVANTOS PTE. LTD., Singapore (SG)

(72) Inventors: Homayoun Kamkar-Parsi, Erlangen (DE); Marko Lugger, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/840,439

(22) Filed: Dec. 13, 2017

(65) Prior Publication Data

US 2018/0176694 A1 Jun. 21, 2018

(30) Foreign Application Priority Data

Dec. 15, 2016 (DE) ..... 10 2016 225 205

(51) Int. Cl.
*H04R 25/00* (2006.01)

(52) U.S. Cl.
CPC ..... *H04R 25/405* (2013.01); *H04R 25/407* (2013.01); *H04R 25/552* (2013.01); *H04R 2430/23* (2013.01)

(58) Field of Classification Search
CPC .. H04R 25/405; H04R 25/407; H04R 25/552; H04R 2430/23; H04R 25/40; H04R 2225/43; H04R 2201/40; H04R 2430/20; G10K 2210/108
See application file for complete search history.

(56) References Cited

U.S. PATENT DOCUMENTS

| | | | | |
|---|---|---|---|---|
| 6,449,593 | B1 | 9/2002 | Valve | |
| 9,277,333 | B2 | 3/2016 | Aubreville et al. | |
| 10,117,029 | B2 | 10/2018 | Andersen et al. | |
| 2002/0181720 | A1* | 12/2002 | Maisano | H04R 3/005 381/92 |
| 2008/0123880 | A1* | 5/2008 | Fischer | H04R 25/407 381/312 |

(Continued)

FOREIGN PATENT DOCUMENTS

| | | | |
|---|---|---|---|
| DE | 102013215131 | A1 | 2/2015 |
| EP | 1116961 | A1 | 7/2001 |

(Continued)

*Primary Examiner* — Fan S Tsang
*Assistant Examiner* — Angelica M McKinney
(74) *Attorney, Agent, or Firm* — Laurence A. Greenberg; Werner H. Stemer; Ralph E. Locher

(57) ABSTRACT

A method determines a direction of a useful signal source in an acoustic system that has a first input transducer and a second input transducer. The first input transducer generates a first input signal from a sound signal from the surroundings and the second input transducer generates a second input signal from the sound signal. The first input signal and the second input signal are used to form a plurality of angle-dependent directional characteristics having a respective fixed central angle and a respective given angular expansion. The signal components pertaining to the individual directional characteristics are examined for the presence of a useful signal from a useful signal source. The applicable central angle is assigned to a useful signal source ascertained in a particular directional characteristic as the direction of the useful signal source.

12 Claims, 3 Drawing Sheets

(56) References Cited

U.S. PATENT DOCUMENTS

| | | | | |
|---|---|---|---|---|
| 2010/0158289 | A1* | 6/2010 | Beck | H04R 25/407 381/313 |
| 2010/0303267 | A1* | 12/2010 | Pedersen | H04R 25/407 381/313 |
| 2012/0127832 | A1* | 5/2012 | Mejia | G01S 3/808 367/124 |
| 2012/0327115 | A1 | 12/2012 | Chhetri et al. | |
| 2014/0314259 | A1* | 10/2014 | Aubreville | H04R 25/407 381/313 |
| 2015/0016628 | A1 | 1/2015 | Li | |
| 2015/0036850 | A1 | 2/2015 | Barthel | |
| 2018/0176697 | A1* | 6/2018 | Kamkar-Parsi | H04R 25/505 |

FOREIGN PATENT DOCUMENTS

| | | | |
|---|---|---|---|
| JP | 2001245382 | A | 9/2001 |
| JP | 2014523679 | A | 9/2014 |
| JP | 2016201595 | A | 12/2016 |
| WO | 2016112969 | A1 | 7/2016 |

* cited by examiner

METHOD AND ACOUSTIC SYSTEM FOR DETERMINING A DIRECTION OF A USEFUL SIGNAL SOURCE

CROSS-REFERENCE TO RELATED APPLICATION

This application claims the benefit, under 35 U.S.C. § 119, of German patent application DE 10 2016 225 205.4, filed Dec. 15, 2016; the prior application is herewith incorporated by reference in its entirety.

BACKGROUND OF THE INVENTION

Field of the Invention

The invention relates to a method for determining at least one direction of a useful signal source in an acoustic system that contains at least a first input transducer and a second input transducer. The first input transducer generates a first input signal from a sound signal from the surroundings and the second input transducer generates a second input signal from the sound signal.

For operation of a hearing device, the algorithms that are used for user-specific amplification and, more generally, for tone matching to input signals of the hearing device that are obtained from the ambient sound often need to be selected on the basis of a respective hearing situation. In this case, the individual hearing situations are manifested as frequently recurring patterns of overlays of interfering sounds or, generally, noise of a useful signal sound, the patterns being standardized inter alia on the basis of the type of noise occurring, the signal-to-noise ratio, the frequency response of the useful signal sound and temporal variations and mean values of the cited variables.

On the basis of the identified hearing situation, it is thus particularly possible for the signal-to-noise ratio in the input signals to be improved in an efficient and resource-saving manner, since this achieves a reduction in the noise by means of its properties that can be expected statistically within the context of the standardization as a hearing situation.

Specifically in particularly complicated real acoustic surroundings—for example with multiple noise sources, which additionally result in a high total noise level—improving the sound quality can, however, result in the requirement for the position of a useful signal source, for example a speaker in a conversation, to be located directly.

At present, it is known practice for useful signal sources to be located in binaural hearing devices by a measurement of the delay time difference that results from the different propagation times of a sound signal to the respective hearing aids of the binaural hearing device that are worn on both ears of the user. However, such a measurement requires firstly a high level of computational complexity and secondly the fastest possible and nevertheless detailed transmission of the signal components from one hearing aid to the other hearing aid through evaluation. The two cited requirements adversely affect the power consumption of the hearing aids.

SUMMARY OF THE INVENTION

The invention is therefore based on the object of specifying for an acoustic system a method that locates a useful signal source as accurately as possible with the lowest possible level of computational and system complexity.

The cited object is achieved according to the invention by a method for determining at least one direction of a useful signal source in an acoustic system that contains at least a first input transducer and a second input transducer. The first input transducer generates a first input signal from a sound signal from the surroundings and the second input transducer generates a second input signal from the sound signal. The first input transducer generates a first input signal from a sound signal from the surroundings and the second input transducer generates a second input signal from the sound signal. The first input signal and the second input signal are used to form a plurality of angle-dependent directional characteristics having a respective given central angle and a respective identical angular expansion. The signal components pertaining to the individual directional characteristics are examined for the presence of a useful signal from a useful signal source, and wherein the applicable central angle is assigned to a useful signal source ascertained in a particular directional characteristic as the direction of the useful signal source. Refinements that are advantageous and in some cases inventive in themselves are the subject matter of the subclaims and the description that follows.

In this context, an input transducer generally covers any acoustoelectric transducer that produces an electrical signal from a sound signal, that is to say particularly also a microphone.

Preferably, the individual directional characteristics have a respective minimum or a respective maximum sensitivity to a test signal from the applicable angular direction at their respective central angle. The directional characteristics in this case include directional lobes, in particular, which have the greatest sensitivity in the direction of their respective central angle, the sensitivity decreasing each time the angular distance from the central angle increases. The extent of the decrease in the sensitivity as the angular distance from the central angle increases can be taken as a measure of the angular expansion of the directional characteristic in this case. Alternatively, the individual directional characteristics can each also have a minimum sensitivity to a given test signal at the respective central angle, the sensitivity to the test signal increasing as the angular distance from the central angle increases. The extent of the increase in the sensitivity as the angular distance from the central angle increases can then be used as a measure of the angular expansion. Preferably, the central angles of two adjacent directional characteristics are at a fixed angular distance from one another. This means that a kind of scan of an angular range is performed by means of the individual directional characteristics, the central angle changing by a constant amount in each case in the event of a transition from one directional characteristic to its adjacent directional characteristic.

The examination of the signal components, including the presence of a useful signal, from a useful signal source can be effected in the individual directional characteristics, particularly on the basis of the signal level or on the basis of one or more variables that are derived from the signal level.

The assignment of a central angle of a directional characteristic as the direction of a useful signal source ascertained in the applicable directional characteristic now has the advantage that this allows the useful signal source to be located even in the presence of other useful signal sources, for example if a new, further useful signal source is added to an already existent useful signal source with an applicable useful signal, the further useful signal source being clearly physically separate from the first, already existent useful signal source. The detection or location of the individual useful signal sources is not impaired by the presence of other useful signal sources in this case, as might occur in the case of a location by use of phase measurement, where every further useful signal source worsens the signal-to-noise ratio at least as noise, and therefore could impair the robustness and also the angular resolution of the locating. In particular, it is then possible to use permanent application, or application repeated at short intervals of time, of the locating to achieve a temporal resolution for the locating of a useful signal source. This therefore also allows physical tracking of a mobile useful signal source. The direction of the useful signal source, which is determined as the result of the method, can be used particularly to orient a directional lobe to the useful signal source during the input conversion of the acoustic system, in order to use the directional lobe to improve the signal-to-noise ratio of the useful signal source relative to the background noise.

Preferably, an angular distance between two directional characteristics that are adjacent in respect of their central angle corresponds to half the angular expansion. In particular, the two adjacent directional characteristics in this case have the same angular expansion. If the individual directional characteristics are formed by directional lobes whose sensitivity is at a maximum in the direction of the central angle, and decreases as the angular distance from the central angle increases, this means particularly that an angle for which the sensitivity to a test signal has fallen by a particular factor relative to the maximum value at the central angle, for example 6 dB or 10 dB, can be specified for every single directional characteristic. Such an angle is now assigned to the applicable directional characteristic as half an angular expansion, and the central angle of the adjacent directional characteristic is accordingly chosen to be at an angular distance of half an angular expansion. If notch-shaped attenuations of the sensitivity with a minimum at the central angle are chosen as individual directional characteristics in each case, a similar situation can apply, with a raise of the sensitivity relative to the minimum value at the central angle being used for the definition of the angular expansion instead of the attenuation of the sensitivity relative to the maximum value at the central angle. This allows largely complete coverage by the individual directional characteristics to be attained for a desired, wider angular range, whereas overlaps in the individual directional characteristics up to the next central angle in each case mean that a useful signal source can always be clearly assigned to at least one of the directional characteristics, the overlap also allowing angular positions between two adjacent central angles to be resolved.

Advantageously, for each of the individual directional characteristics the central angle and the angular expansion of the directional characteristic are determined by at least two conditions. In particular, the directional characteristics can each be formed using the "linearly constrained minimum variance" method on the basis of the conditions. This allows the conditions, for example in the form of relative attenuations in the sensitivity, to be oriented in a particular angular direction, and allows the respective directional characteristics to be formed directly therefrom.

It is found to be advantageous if the individual directional characteristics are each prescribed by a notch-shaped sensitivity characteristic that is determined by at least two conditions, so that the at least two conditions each stipulate the central angle and the angular expansion of the sensitivity characteristic. In this case, a notch-shaped sensitivity characteristic is intended to be understood to mean a directional characteristic that has the maximum attenuation in the sensitivity for a test signal of prescribed volume at the central angle, the sensitivity increasing as the angular distance from the central angle increases. The extent of this increase in the sensitivity on the basis of the angular distance from the central angle then defines the angular expansion. If a useful signal source is situated in the direction of a central angle of such a directional characteristic, or, within the context of the angular resolution, in direct proximity to the central angle, that is to say within the "notch" of the sensitivity characteristic, then the signal components of the useful signal are substantially attenuated by the directional characteristic, whereas signal components of other useful signal sources that are situated outside the angular expansion around the central angle of the directional characteristic are largely retained. This can now be used to ascertain a presence of a useful signal source in the region of the applicable directional characteristic.

Expediently, an acoustic characteristic variable is formed for each of the individual directional characteristics from the signal components, the acoustic characteristic variables of the directional characteristics are used to ascertain a useful signal in at least one of the directional characteristics. The acoustic characteristic variable used in this case can be particularly the maximum signal level over a suitable time window or the signal level averaged over the time window, particularly only signal components in particular frequency bands also being able to be used for the formation of the acoustic characteristic variables.

Preferably, in this case, the acoustic characteristic variable of the directional characteristic is compared with the total value of the corresponding characteristic variable for the first input signal and/or the second input signal, and a relative characteristic variable for the directional characteristic is formed as a result, wherein the presence of a useful signal in at least one of the directional characteristics is ascertained from the relative characteristic variable of the directional characteristics. This means that the acoustic characteristic variable, for example a signal level averaged over time, is first of all formed for each of the individual directional characteristics, and subsequently the acoustic characteristic variable of each directional characteristic is normalized using an appropriate characteristic variable that is derived from the first input signal and/or from the second input signal. The normalization then forms for each directional characteristic the relative characteristic variable that is ultimately used as a measure of the presence of a useful signal in the directional characteristic. The characteristic variable used for the normalization can be the reference level of the first input signal or of the second input signal or else the total level of the first input signal and the second input signal, for example. The effect that can be achieved by the normalization is that in hearing situations in which the respective sound level or else the number of individual useful signal sources can change, the resultant changes in the overall level do not affect the resolution of the locating of the useful signal sources.

Preferably, in this case, the relative characteristic variables are each compared with one another and/or with a prescribed limit value, and the presence of a useful signal in at least one of the directional characteristics is ascertained therefrom. The comparison of the relative characteristic variables with one another is found to be advantageous to the effect that it allows the presence of a useful signal in the applicable directional characteristic to be inferred directly from an extreme value (maximum or minimum) of a relative characteristic variable, depending on the nature of the directional characteristics. To locate a plurality of useful signal sources, however, it may also be advantageous to compare the relative characteristic variables with a prescribed limit value that, when exceeded or fallen below, allows the presence of a useful signal source to be inferred.

It is found to be advantageous if the characteristic variable used is a respective mean value of the signal level over time, and the presence of a useful signal in a directional characteristic is ascertained from an attenuation that the mean value of the signal level over time experiences in the directional characteristic, normalized using the mean value of the total level over time, as a result of the respective sensitivity characteristic. The time window for the averaging can be dependent particularly on the nature of the useful signal sources that is to be expected. If at least one of the useful signal sources is an interlocutor, for example, then the time window can preferably be chosen such that particular frequency bands, e.g. format frequencies, are excited to a sufficiently high degree.

In an advantageous refinement, a further input transducer generates a further input signal from the sound signal, wherein the directional characteristics are formed on the basis of the first input signal, the second input signal and the further input signal. Preferably, the further input transducer is physically separate from the first input transducer and from the second input transducer in this case. The addition of the further input signal increases the total available phase information about the sound signal, so that the directional characteristics can be used to achieve a higher angular resolution.

It is found to be particularly advantageous in this case if the individual directional characteristics are each provided by a plurality of conditions that is the same as the number of input signals, so that the plurality of conditions each stipulate at least the central angle and the angular expansion. This means that, in the case of four input signals from four physically separate input transducers, for example, the individual directional characteristics can each be stipulated by up to four conditions. This allows particularly narrow angular expansions and therefore a particularly high angular resolution to be attained.

The invention further cites an acoustic system, containing at least one first input transducer for producing a first input signal from a sound signal from the surroundings, a second input transducer, a second input transducer for producing a second input signal from the sound signal, and a signal processing unit 50 that is set up to perform the method described above. In particular, the acoustic system is configured as a hearing device. The advantages cited for the method and the developments thereof can be transferred mutatis mutandis to the acoustic system in this case.

Other features which are considered as characteristic for the invention are set forth in the appended claims.

Although the invention is illustrated and described herein as embodied in a method for determining a direction of a useful signal source, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Mutually corresponding parts and variables are each provided with the same reference symbols in all the figures.

Figure 1A:
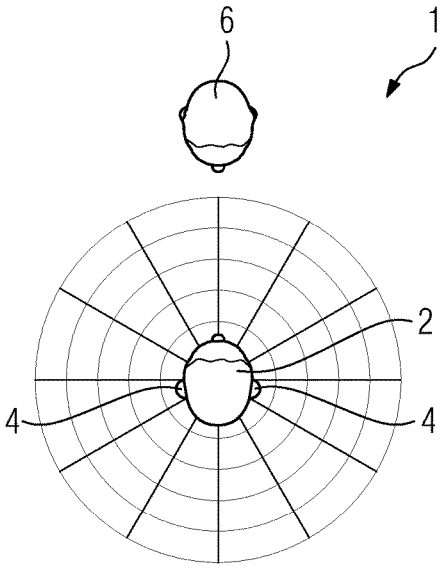
FIGS. 1A and 1B are plan views of a hearing situation for a user of a binaural hearing device in which the number of interlocutors for the user changes.
Figure 1B:
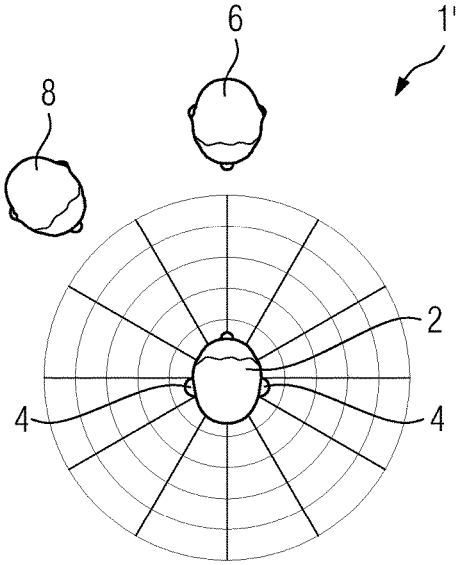

Referring now to the figures of the drawings in detail and first, particularly to FIGS. 1A and 1B thereof, there is shown schematically a plan view of a hearing situation 1. In the left-hand depiction, namely FIG. 1A, a user 2 of an acoustic system 4, which in the present case is configured as a binaural hearing device, is in a conversation with a first interlocutor 6, who is positioned at the front relative to the line of vision of the user 2, that is to say is standing at an angle of 0 degrees relative to the user 2. For this hearing situation 1, the binaural hearing device has located the position of the interlocutor 6 as part of its resolution options. After some time in the conversation, a second interlocutor 8 now joins, which results in a new hearing situation 1', see FIG. 1B. The second interlocutor 8 is positioned approximately at an angle of −45 degrees relative to the line of vision of the user 2. If a directional characteristic oriented to the first interlocutor 6 is now formed in the binaural hearing device, for example to better amplify the original signal, that is to say the signal from the first interlocutor 6, then components of the conversation of the second interlocutor 8 are rejected or are not sufficiently captured by such a directional characteristic. So as now to be able to perform direction-dependent rejection of background noise in the changed hearing situation 1', and also not to substantially rejected contributions to the conversation by the second interlocutor 8 relative to those of the first interlocutor 6, it is of considerable advantage to locate the position of the second interlocutor 8 as accurately as possible.

Figure 2:
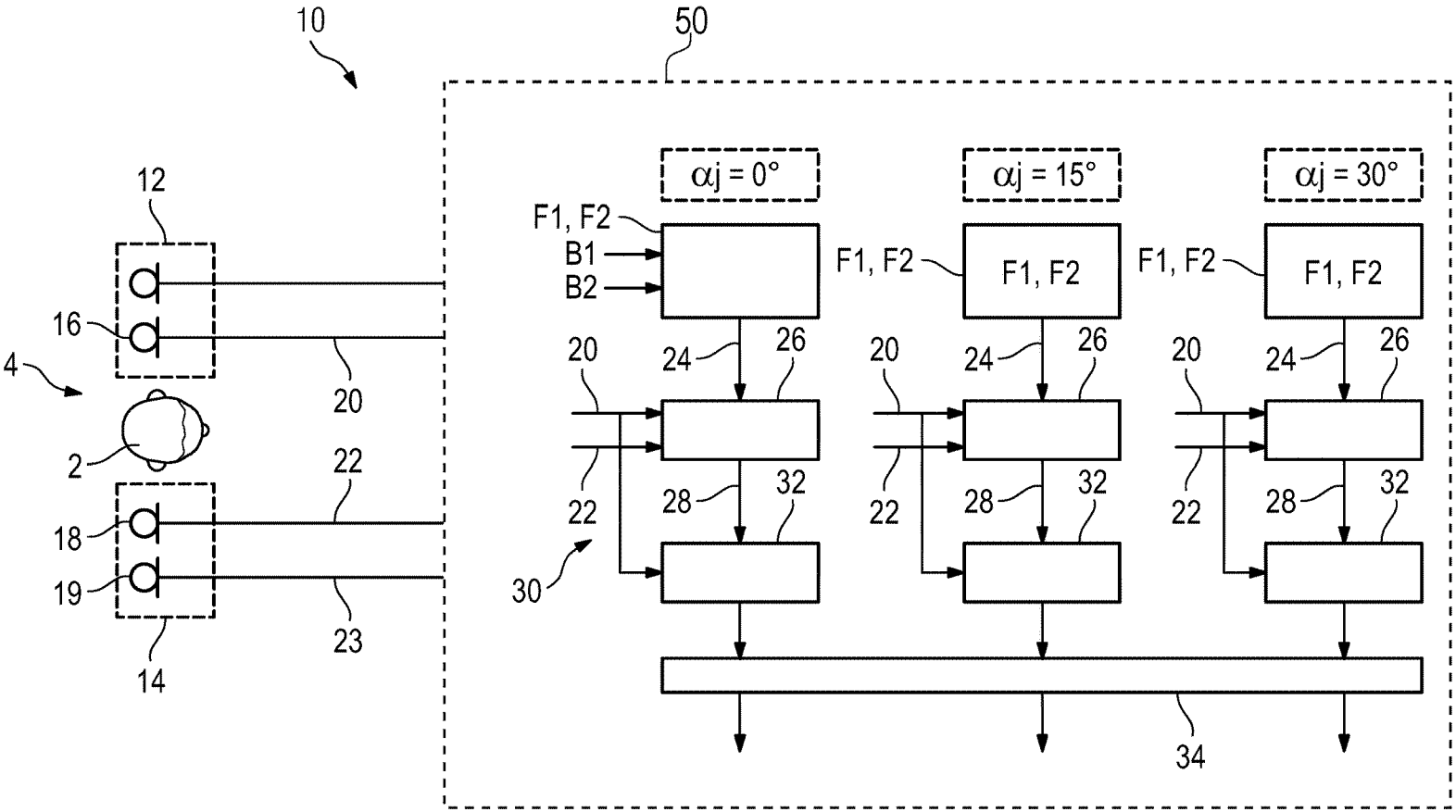
FIG. 2 is a block diagram of a sequence of a method for determining a direction of a useful signal source.

FIG. 2 depicts a block diagram of the sequence of a method 10 for determining a direction of a useful signal source in an acoustic system 4. In the present case, the useful signal source is provided by the first interlocutor 6 or the second interlocutor 8 in one of the two hearing situations 1, 1' which are in FIGS. 1A and 1B. The acoustic system 4 is formed by a binaural hearing device in the present case. The binaural hearing device contains a first local unit 12 and a second local unit 14, which can each be worn on the left or right ear of the user 2 when the binaural hearing device is used as intended. The first local unit 12 or the second local unit 14 has a first input transducer 16 or a second input transducer 18 that generates a first input signal 20 or a second input signal 22 from a respective incoming sound signal from the surroundings. The first input transducer 16 and the second input transducer 18 are each provided by a microphone in the present case. If need be, a further input transducer 19 may also be provided that produces a further input signal 23.

For a plurality of central angles $\alpha j$, which cover the front hemisphere of the user 2 in steps of 15 degrees in both directions starting from 0 degrees, a first filter parameter F1($\alpha j$) and a second filter parameter F2($\alpha j$) are now each defined on the basis of two conditions B1, B2. The first filter parameter F1($\alpha j$) and the second filter parameter F2($\alpha j$) are in this case of a nature such that they form a notch-shaped sensitivity characteristic 24 by convolution with the first input signal 20 or the second input signal 22 in a manner yet to be described. If the first input signal 20 and the second input signal 22 are thus each filtered using the first filter parameter F1($\alpha j$) or the second filter parameter F2($\alpha j$), then the sum of the resultant signals has a much lower sensitivity for signal components whose signal source is in the direction of the central angle $\alpha$j of the sensitivity characteristic 24 than for signals whose signal source is in another direction. For the signal 26 resulting from the filtering described, an acoustic characteristic variable 28 is now formed by virtue of the signal level of the resultant signal 26 being averaged over a prescribed interval of time. The acoustic characteristic variable 28 formed from the averaged signal level is normalized using a reference level 30, and in this way a relative characteristic variable 32 is formed. In the present case, the reference level 30 is provided by a mean value of the level of the first input signal 16 over time. Alternatively, the reference level 30 used may also be a mean value of the overall level over time, that is to say of the level of the sum of the first input signal 16 and the second input signal 18. The relative characteristic variables 32 thus formed for a central angle $\alpha$j are now each compared with one another. In the comparison 34, each central angle $\alpha$j whose sensitivity characteristic 24 has the relative characteristic variable 32 with the lowest value is now stipulated as the direction of a useful signal source.

Figure 3:
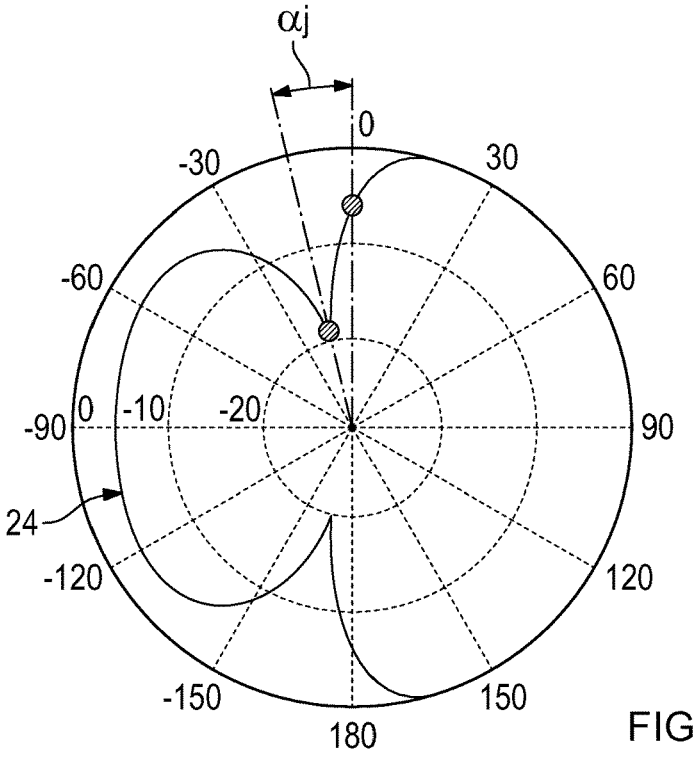
FIG. 3 is a plan view of a directional characteristic of the hearing device shown in FIGS. 1A and 1B at a given central angle and a given angular expansion.

FIG. 3 depicts a plan view of a directional characteristic 34 with a central angle $\alpha j=-10$ degrees and a prescribed expansion $\Delta$. In this case, the directional characteristic is formed by a sensitivity characteristic 24 whose central angle $\alpha$j is defined by the direction having the lowest sensitivity. The concepts of "linearly constrained minimum variants" directional characteristics (LCMV) can be used to define each of the central angle $\alpha$j and the expansion $\Delta$ by means of a given attenuation of the signal components at the central angle $\alpha$j itself and at a further angle. In the present case, the angular expansion $\Delta$ is determined by virtue of the signal level being attenuated by 20 dB at a central angle $\alpha$j of −10 degrees, and the signal level being attenuated by 6 dB in the frontal direction, that is to say at 0 degrees. This defines a notch-shaped sensitivity characteristic 24 that has substantially lower sensitivity for signals whose source is in the region of the central angle $\alpha$j, and rejects such signals accordingly.

If the signal level averaged over time is now first of all formed method depicted in FIG. 2 for a signal whose signal source is in the direction of the central angle $\alpha j=-10$ degrees, that is to say in the case of an accordingly positioned interlocutor, for example, according to the sensitivity characteristic 24, then the signal level has the lowest possible value as acoustic characteristic variable 28 for the present signal source of all the angle-dependent sensitivity characteristics 24. The acoustic characteristic variable 28 obtained in this manner is now normalized using the total level averaged over time or the level of one of the two input signals 20, 22 averaged over time. This results, in the event of a speaker, that is to say a useful signal source, being absent in the region of the central angle $\alpha$j, in all contributions being captured for normalization essentially even without attenuation in the acoustic characteristic variable 28. Only when a useful signal source is present in the region of the central angle $\alpha$j is the contribution of the useful signal to the acoustic characteristic variable 28 substantially rejected by the sensitivity characteristic 24, whereas the contribution to the normalization by the useful signal is retained. The corresponding decrease in the relative characteristic variable 32 then allows the presence of a useful signal source in the direction of the central angle $\alpha$j to be safely inferred.

Figure 4:
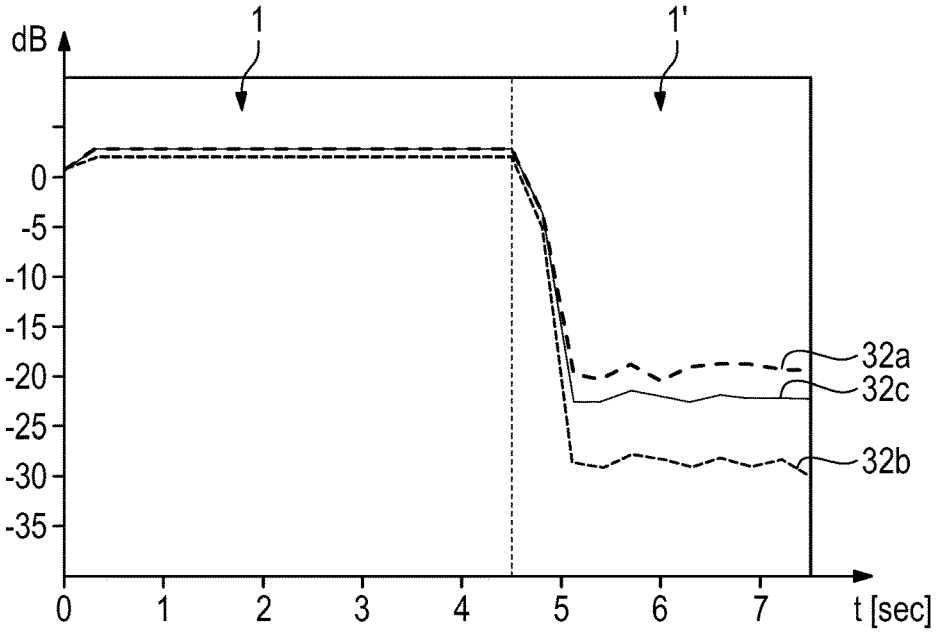
FIG. 4 is a graph showing a profile of relative characteristic variables for locating a speaker for a hearing situation as shown in FIGS. 1A and 1B over a time axis.

FIG. 4 depicts the relative characteristic variables 32*a* to 32*c* for each of three different central angles over a time axis t, the characteristic variables being assignable to the hearing situations 1, 1' depicted in FIG. 2. Up to a time of approximately 4.5 seconds, the user 2 is only in conversation with the first interlocutor 6. The relative characteristic variables 32*a* to 32*c*, which are formed in a prescribed manner for sensitivity characteristics with central angles of −30 degrees (32*a*), −45 degrees (32*b*) and −60 degrees (32*c*), consequently have no kind of reference points for a useful signal source in the applicable angular range. At approximately 4.5 seconds, the transition from hearing situation 1 to hearing situation 1' now occurs, the second interlocutor 8 joins and, in so doing, makes contributions to the conversation that now enter the processes described above as a sound signal. The contributions to the conversation by the second interlocutor 8 and the further presence of the first interlocutor 6 mean that the normalization changes first of all for each of the three relative characteristic variables 32*a* to 32*c* depicted. The most distinct attenuation of the contribution of the second interlocutor 8 is effected, as expected, by the sensitivity characteristic with the central angle at −45 degrees, so that the relative characteristic variable 32*b* accordingly also adopts the lowest value therefor. For the other two central angles −30 degrees and −60 degrees, the applicable sensitivity characteristics mean that a certain attenuation of the voice activity of the second interlocutor 8 still takes place. However, this attenuation is no longer as pronounced as in the case of the sensitivity characteristic at −45 degrees. Accordingly, a drop in the value can be seen in the relative characteristic variables 32*a* and 32*c*, which does not approach the reduction from −45 degrees (32*b*), however. From this, it is now possible to infer the joining of the second interlocutor 8 at approximately 4.5 seconds at an angle of −45 degrees.

Although the invention has been illustrated and described in more detail by the preferred exemplary embodiment, the invention is not limited by this exemplary embodiment. Other variations can be derived therefrom by a person skilled in the art without departing from the scope of protection of the invention.

The following is a summary list of reference numerals and the corresponding structure used in the above description of the invention:

1 Hearing situation
2 User
4 Acoustic system
6 First interlocutor
8 Second interlocutor
10 Method
12 First local unit
14 Second local unit
16 First input transducer
18 Second input transducer
19 Further input transducer
20 First input signal
22 Second input signal
23 Further input signal
24 Sensitivity characteristic
26 Resultant signal
28 Acoustic characteristic variable
30 Reference level
32 Relative characteristic variable

32*a-c* Relative characteristic variable
34 Directional characteristic
B1, B2 Condition
F1 First filter parameter
F2 Second filter parameter
αj Central angle
Δ Expansion

The invention claimed is:

1. A method for determining at least one direction of a useful signal source in an acoustic system having at least a first input transducer and a second input transducer, which comprises the steps of:

generating, via the first input transducer, a first input signal from a sound signal from surroundings;

generating, via the second input transducer, a second input signal from the sound signal;

using the first input signal and the second input signal to form a plurality of angle-dependent directional characteristics each having a respective fixed central angle and a respective given angular expansion;

examining signal components pertaining to individual ones of the angle-dependent directional characteristics for a presence of a useful signal from the useful signal source; and assigning the respective fixed central angle to the useful signal source ascertained in a respective angle-dependent directional characteristic as the direction of the useful signal source.

2. The method according to claim 1, wherein an angular distance between two said angle-dependent directional characteristics that are adjacent in respect of the respective fixed central angle corresponds to half the respective given angular expansion.

3. The method according to claim 2, wherein for each of the angle-dependent directional characteristics the respective fixed central angle and the respective given angular expansion of an angle-dependent directional characteristic are prescribed by at least two conditions.

4. The method according to claim 3, wherein the angle-dependent directional characteristics are each prescribed by a notch-shaped sensitivity characteristic that is determined by the at least two conditions, so that the at least two conditions each stipulate the respective fixed central angle and the respective given angular expansion of the notch-shaped sensitivity characteristic.

5. The method according to claim 4, which further comprises forming an acoustic characteristic variable for each of the angle-dependent directional characteristics from the signal components, wherein acoustic characteristic variables of the angle-dependent directional characteristics are used to ascertain the useful signal in at least one of the angle-dependent directional characteristics.

6. The method according to claim 5, which further comprises:

comparing the acoustic characteristic variable of the angle-dependent directional characteristic with a total value of a corresponding characteristic variable for the first input signal and/or the second input signal and a relative characteristic variable for the angle-dependent directional characteristic is formed as a result; and ascertaining a presence of the useful signal in at least one of the angle-dependent directional characteristics from the relative characteristic variable of the angle-dependent directional characteristics.

7. The method according to claim 6, which further comprises:

comparing relative characteristic variables with one another and/or with a prescribed limit value; and ascertaining a presence of the useful signal in at least one of the angle-dependent directional characteristics from results of the comparing step.

8. The method according to claim 5, which further comprises:

setting the acoustic characteristic variable to be a respective mean value of a signal level over time; and ascertaining a presence of the useful signal in the angle-dependent directional characteristic from an attenuation that the respective mean value of the signal level over time experiences in the angle-dependent directional characteristic, normalized using a mean value of a total level over time, as a result of the notch-shaped sensitivity characteristic.

9. The method according to claim 4, which further comprises:

providing a further input transducer that generates a further input signal from the sound signal; and forming the angle-dependent directional characteristics on a basis of the first input signal, the second input signal and the further input signal.

10. The method according to claim 9, wherein the angle-dependent directional characteristics are each provided by a plurality of conditions that is a same as a number of input signals, so that the plurality of conditions each stipulate at least the respective fixed central angle and the respective given angular expansion of the notched shaped sensitivity characteristic.

11. An acoustic system, comprising:

at least one first input transducer;

a second input transducer; and a signal processing unit programmed to perform a method for determining at least one direction of a useful signal source in the acoustic system, the method comprises the steps of:

generating, via said first input transducer, a first input signal from a sound signal from surroundings;

generating, via said second input transducer, a second input signal from the sound signal;

using the first input signal and the second input signal to form a plurality of angle-dependent directional characteristics each having a respective fixed central angle and a respective given angular expansion;

examining signal components pertaining to individual ones of the angle-dependent directional characteristics for a presence of a useful signal from a useful signal source; and assigning the respective fixed central angle to the useful signal source ascertained in a respective angle-dependent directional characteristic as the direction of the useful signal source.

12. The acoustic system according to claim 11, wherein the acoustic system is a hearing device.

* * * * *